US006250993B1

(12) United States Patent
Carriou

(10) Patent No.: US 6,250,993 B1
(45) Date of Patent: Jun. 26, 2001

(54) METHOD FOR FINISHING SPECTACLE LENSES, AND RELATED DEVICE

(75) Inventor: Xavier Carriou, Le Plessis Mace (FR)

(73) Assignee: Essilor International Compagnie Generale d'Optique, Charenton le Pont (FR)

( * ) Notice: Subject to any disclaimer, the term of this patent is extended or adjusted under 35 U.S.C. 154(b) by 0 days.

(21) Appl. No.: 09/341,870

(22) PCT Filed: Nov. 20, 1997

(86) PCT No.: PCT/FR97/02099

§ 371 Date: Oct. 7, 1999

§ 102(e) Date: Oct. 7, 1999

(87) PCT Pub. No.: WO99/26759

PCT Pub. Date: Jun. 3, 1999

(51) Int. Cl.[7] ..... B24B 1/00
(52) U.S. Cl. ..... 451/42; 451/41
(58) Field of Search ..... 451/42, 41, 63, 451/43, 28, 5, 390, 364, 177, 178

(56) References Cited

U.S. PATENT DOCUMENTS

| | | | | |
|---|---|---|---|---|
| 4,025,033 | | 5/1977 | Hodges . | |
| 5,148,637 | | 9/1992 | Byron . | |
| 5,630,746 | | 5/1997 | Gottschald et al. . | |
| 5,660,578 | | 8/1997 | Clara . | |
| 5,908,348 | * | 6/1999 | Gottschald | 451/43 |
| 6,050,877 | * | 4/2000 | Shibata et al. | 451/43 |

FOREIGN PATENT DOCUMENTS

| | | |
|---|---|---|
| 40 12 660 | 6/1992 | (DE) . |
| 0 235 543 | 9/1987 | (EP) . |
| 0 298 129 | 1/1989 | (EP) . |
| 0 444 902 | 9/1991 | (EP) . |
| WO 95/03918 | 2/1995 | (WO) . |

* cited by examiner

*Primary Examiner*—Derris H. Banks
(74) *Attorney, Agent, or Firm*—Young & Thompson

(57) ABSTRACT

The invention concerns a method for finishing a spectacle lens after it has been cut a first time, in order to pass said spectacle lens again on the grinder, which consists in implanting thereon a prehensile block for setting it on such a grinder. The invention is characterized in that it consists in implanting the block at some point of the spectacle lens preferably close to the center, in reading the spectacle lens outline leading to a reading of the read form for said spectacle lens, and in actuating the grinder on the basis of the difference between said read form and the desired final form.

16 Claims, 1 Drawing Sheet

METHOD FOR FINISHING SPECTACLE LENSES, AND RELATED DEVICE

Figure 1:
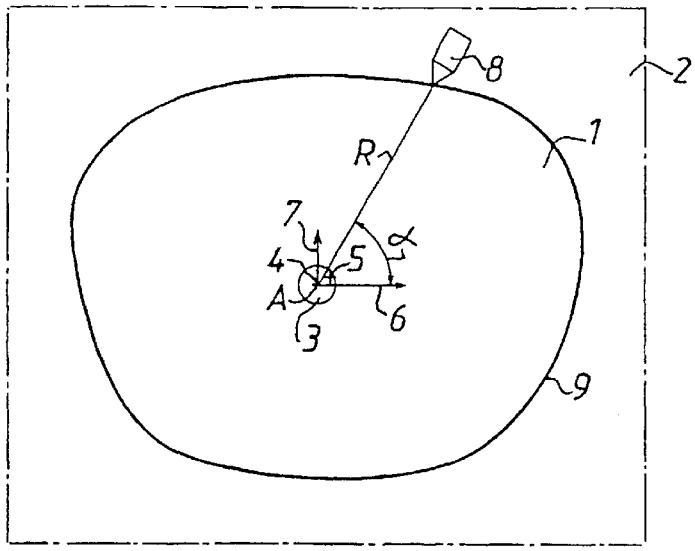

The invention concerns a method for finishing spectacle lenses after first cutting thereof, of the kind in which, for the purpose of a further passage of the spectacle lens through a grinding machine, a holding block is fitted to it for holding it in place on the grinding machine. A method of this kind is conventionally used by opticians for accurate fitting of a lens to a spectacle frame of their client. The invention also concerns the related device.

Spectacle lenses are made in the form of substantially circular blanks providing a particular optical correction. They are then cut by the manufacturer or the optician to the shape of the spectacle frames selected by the client. Clearly the cutting must be done allowing for the shape of the frame and for the position of the eyes of the user. The optical centre of the lens must be correctly placed in front of the eye for the required correction of vision to be obtained.

Usually, the first cut is made slightly outside the required final cut and the lens must then be finished to fit it perfectly to the frame, in particular in the case of metal frames.

The optician then has to perform the finishing cut on the lens subject to the same shape and optical centre constraints and within a time interval that is naturally limited by the desire of the client to collect their spectacles quickly.

In standard practice the lens is usually removed from its first cutting support for a trial fit of the lens to the frame and any defect is noted only at this time. Also, it is increasingly common for the optician not to cut the lens directly, but to transmit the measurements corresponding to a frame and a client to the lens manufacturer, who delivers the lens cut to size and bevelled and demounted from its cutting support, and in this case the lens may then require further finishing.

Two finishing methods are employed at present. The first consists in finishing trial and error by the optician, who recuts all or part of the contour of the lens, with the obvious drawbacks of lack of precision of the shape or partial offsetting of the optical centre relative to the eye of the user.

The second method uses an automated machine which requires of the optician precise orientation of the lens axes and positioning of the lens centre, followed by fitting the holding block to the lens at a precise point, allowing for the position of the eye of the user. The optician then uses a mechanical or digital contour reading device to read off the required final shape of the lens, corresponding to the client's frame. The contour reading device then controls the grinding of the lens to the required final shape when placed on the grinding machine with the holding block fitted to it. This method is complex and time consuming and any positioning error manifests itself in the final shape of the lens only after grinding.

The invention is directed to a spectacle lens finishing method that is quick to use and which finishes the lens precisely.

To this end the invention proposes a method of finishing a spectacle lens after first cutting thereof, of the kind in which, for a further passage of the spectacle lens through a grinding machine, a holding block is fitted to it for holding it in place on the grinding machine, characterized in that the block is fitted at any point of the spectacle lens, preferably close to its centre, the contour of the spectacle lens is read to provide a read shape for the spectacle lens, and the grinding machine is operated in accordance with the difference between the read shape and the required final shape.

In the above method, the read shape is preferably compared to the required final shape and a grinding function is established allowing for the difference between the read shape and the final shape and the grinding machine is controlled accordingly.

Clearly the above method can compensate an offset position of the block on the lens by the optician, thanks to reading the shape, which provides a reference for its own grinding, instead of using the centre of the lens as the reference as in the prior art, as this would then have to be determined precisely, as already pointed out.

The invention is also directed to a device for implementing a method as described above including means for comparing two shapes and means for establishing a grinding function allowing for the difference between the two shapes.

Figure 2:
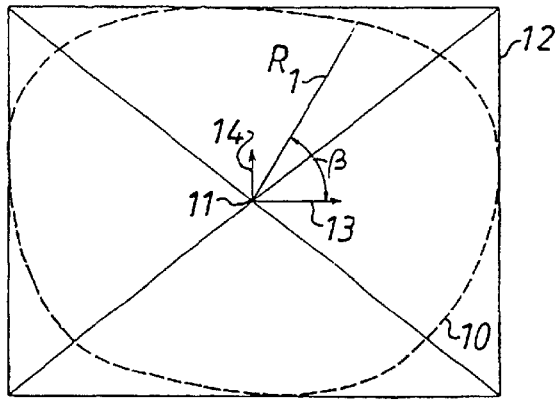
Figure 3:
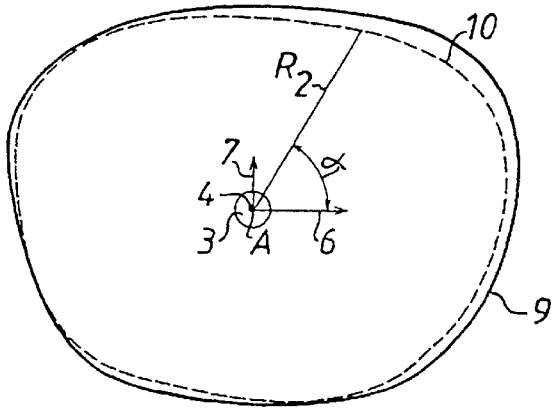

The description and the drawing of a preferred embodiment of the invention given hereinafter explain clearly the aims and advantages of the invention. Clearly this description is given by way of example and is not limiting on the invention. In the drawing:

FIG. 1 is a diagrammatic representation of the lens contour reading principle, FIG. 2 is a representation of the required final shape of the lens, FIG. 3 is a diagrammatic representation of the grinding trajectory for finishing the lens to the required final shape.

To use the method, the optician employs a device to implant the holding block on the spectacle lens to be finished, a contour reading device 2, for example a mechanical device, and a spectacle lens grinding machine, these various means being conventional in the art and therefore not described in more detail here.

When finishing a spectacle lens 1 assumed to have initially been cut too large, a holding block 3, for example in the form of an "acorn", is first fixed by the optician to any point 4, preferably close to the centre 5 of the lens, so that the lens 1 is fixed relative to an axis A substantially perpendicular to its reference plane.

The lens is then fixed into the contour reading device 2 (FIG. 1), around its block 3, for example, in any orientation characterized by the axes 6, 7. In the case of a mechanical contour reading device, a feeler 8 acquires the read shape 9 of the lens during one rotation of the lens 1 about the axis A, thus determining a function of the type $R=f(\alpha)$, where R is the distance from the point read to the axis A and $\alpha$ is the angle the lens has rotated from its initial fixed position. The data constituting the read shape 9 of the lens obtained by the feeler 8 is transmitted to a control unit which is conventionally a computer integrated into the contour reading device 2.

The required final shape 10 of the lens is also stored in a manner known in itself in the control unit and is defined, for example, and as shown in FIG. 2, by a "centre boxing" point 11, which corresponds to the centre of a rectangle 12 within which the required final shape is inscribed, said rectangle having main directions 13, 14 corresponding to the vertical and horizontal directions of the frame when worn by the user, by two perpendicular axes, for example in the directions 13, 14 of the rectangle in which the required final shape 10 is inscribed, and by a polar coordinates function $R1-f1(\beta)$, where R1 is the distance from the point on the required final shape of the lens 1 to its centre 11 for a rotation $\beta$ about the theoretical axes 13, 14.

The "placing" by the computer of the required final shape 10 in the read shape 9 (FIG. 3) is effected by means known to the skilled person, for example using an algorithm to seek the minimum distance from the read shape 9 to the required final shape 10. Clearly the read shape 9 is assumed to be close to the required shape 10.

A grinding function $R2=f2(\alpha)$ is finally obtained corresponding to the conversion of the function f1 for the final shape 10 in the system of axes 11, 13, 14 into a function in the system of axes 4, 6, 7.

The computer controls grinding of all or part of the contour of the lens 1 in accordance with these results and in a conventional manner.

As is clear from reading the description, the method has the advantage of simplicity of use for the optician and an overall saving in time, the time required to read the contour and to calculate the grinding trajectory correction being largely compensated by the elimination of the time spent by the optician centring and orienting the lens.

The description refers to a fixing "acorn", which is conventional in this art. Nevertheless, any type of lens fixing is satisfactory from the point of view of the invention, provided that it guarantees a fixed position of the lens relative to the grinding machine. Thus fixing by means of a sucker is feasible, without changing the method.

In one variant of positioning the required final shape 10 within the read shape 9, because the read shape is assumed to be close to the required final shape 10, with only a few minor contour corrections, an algorithm for determining the principle axes of inertia and the centre of inertia of the two shapes can be used.

In another variant, the feeler and the grinding machine are integrated into the same machine and so the reading axis and the grinding axis are one and the same.

The scope of the present invention is not limited to the details of the embodiments described hereinabove by way of example, but to the contrary encompasses all modifications that will suggest themselves to the skilled person.

What is claimed is:

1. A method of preparing a spectacle lens, comprising the steps of fitting a spectacle lens blank to a holding block and cutting the lens blank to a first approximation of a contour of a lens frame to obtain a cut lens, removing the cut lens from the holding block, thereafter fitting thereafter the cut lens to a holding block at a location close to a center of the cut lens, reading the contour of the cut lens to obtain data corresponding to a read shape thereof, providing data corresponding to the read shape and data corresponding to a desired final shape of the spectacle lens, and controlling a grinding machine in accordance with the difference between the data to obtain the desired final shape of the spectacle lens.

2. A method according to claim 1, wherein after the step of removing the cut lens from the holding block, effecting a trial fit of the cut lens in a spectacle frame intended therefor.

3. A method according to claim 1, wherein after the step of removing the cut lens from the holding block, the cut lens is positioned relative to a user's eye.

4. A method according to claim 1, wherein the lens blank is cut to a first approximation on a first grinding machine different from the grinding machine controlled with the difference of the data to obtain the desired final shape of the spectacle lens.

5. A method according to claim 1, wherein the cut lens is beveled and cut to a first approximation of the contour before the step of removing the cut lens from the holding block.

6. A method according to claim 1, wherein the cut lens is fitted to a holding block without precision centering of the holding block relative to the center of the cut lens, whereby the optical axis of the cut lens is somewhat offset from an axis of the holding block.

7. A method according to claim 1, wherein a grinding function is established for controlling the grinding machine based on the difference of the data of the read shape of the cut lens and the data of the desired final shape of the spectacle lens.

8. A device for finishing a spectacle lens blank cut to a first approximation of a contour of a lens frame therefor, comprising a holding block for receiving and then holding a cut spectacle lens blank at a location proximate to a center of the cut lens, means for reading the contour of the cut lens to obtain data corresponding to a read shape of the cut lens, said means for reading comprising means for positioning the cut lens on the holding block, means for providing data corresponding to a read shape of the cut lens and data corresponding to a desired final shape of the spectacle lens, grinding means for grinding the cut lens to the desired final shape, and means for controlling the grinding machine in accordance with the difference between the data corresponding to the read shape of the cut lens and data corresponding to the desired final shape of the spectacle lens.

9. A device according to claim 8, further comprising means for comparing the read shape of the cut lens and the desired final shape of the spectacle lens and means for establishing a grinding function based on the difference between the two shapes.

10. A device according to claim 8, wherein said means for comparing the read shape and the desired final shape and the means for establishing a grinding function are integrated into the means for reading the contour.

11. A device according to claim 8, wherein said means for comparing the read shape and the desired final shape and the means for establishing a grinding function are integrated into the grinding machine.

12. A device according to claim 8, wherein the holding block comprises an acorn-like member.

13. A device according to claim 8, wherein the holding block comprises a sucker.

14. A device according to claim 8, wherein said means for reading the contour of the cut lens is digitally operated.

15. A device according to claim 8, wherein said means for reading the contour of the cut lens is mechanically operated.

16. A device for finishing a spectacle lens blank cut to a first approximation of a contour of a lens frame therefor, comprising a holding block for receiving and then holding a cut spectacle lens blank at a location proximate to a center of the cut lens, means for reading the contour of the cut lens to obtain data corresponding to a read shape of the cut lens, means for providing data corresponding to a read shape of the cut lens and data corresponding to a desired final shape of the spectacle lens, grinding means for grinding the cut lens to the desired final shape, and means for controlling the grinding machine in accordance with the difference between the data corresponding to the read shape of the cut lens and data corresponding to the desired final shape of the spectacle lens, and wherein said means for comparing the read shape and the desired final shape and the means for establishing a grinding function are integrated into a machine for grinding and contour reading, the machine having a grinding axis which coincides with a reading axis.

* * * * *